US010920465B2

(12) United States Patent
Wilke et al.

(10) Patent No.: US 10,920,465 B2
(45) Date of Patent: Feb. 16, 2021

(54) INTERIOR DOOR LOCK OPERATOR INTEGRATED INTO PULL DOOR HANDLE

(71) Applicant: ILLINOIS TOOL WORKS INC., Glenview, IL (US)

(72) Inventors: Zsolt Wilke, Bad Mergentheim (DE); Roland Och, Rottendorf (DE); Matthias Seubert, Giebelstadt (DE)

(73) Assignee: Illinois Tool Works Inc., Glenview, IL (US)

( * ) Notice: Subject to any disclaimer, the term of this patent is extended or adjusted under 35 U.S.C. 154(b) by 587 days.

(21) Appl. No.: 15/447,923

(22) Filed: Mar. 2, 2017

(65) Prior Publication Data

US 2017/0254124 A1 Sep. 7, 2017

(30) Foreign Application Priority Data

Mar. 3, 2016 (DE) ..... 10 2016 103 897

(51) Int. Cl.

| | |
|---|---|
| ***E05B 77/22*** | (2014.01) |
| ***E05B 77/24*** | (2014.01) |
| ***E05B 81/00*** | (2014.01) |
| ***E05B 85/12*** | (2014.01) |
| ***E05B 79/22*** | (2014.01) |
| ***E05B 81/76*** | (2014.01) |

(52) U.S. Cl.

CPC ..... *E05B 85/12* (2013.01); *E05B 77/22* (2013.01); *E05B 77/245* (2013.01); *E05B 79/22* (2013.01); *E05B 81/00* (2013.01); *E05B 81/76* (2013.01)

(58) Field of Classification Search

CPC ..... E05B 85/12; E05B 81/76; E05B 79/22; E05B 81/00; E05B 77/245; E05B 77/22; E05B 85/107; E05B 83/36

See application file for complete search history.

(56) References Cited

U.S. PATENT DOCUMENTS

| | | | | |
|---|---|---|---|---|
| 7,090,285 | B2 * | 8/2006 | Markevich | E05B 85/12 296/153 |
| 8,586,878 | B2 * | 11/2013 | Lee | B60N 2/0228 174/50 |
| 9,611,678 | B2 * | 4/2017 | Weinerman | E05C 3/24 |
| 10,550,611 | B2 * | 2/2020 | Och | E05B 85/103 |
| 2006/0145513 | A1 | 7/2006 | Markevich et al. | |
| 2006/0208506 | A1 * | 9/2006 | Kern | B60R 7/04 292/304 |
| 2015/0337570 | A1 | 11/2015 | Powell et al. | |
| 2016/0032625 | A1 | 2/2016 | Suzuki | |

FOREIGN PATENT DOCUMENTS

| | | | |
|---|---|---|---|
| CN | 103711361 | A | 4/2014 |

* cited by examiner

*Primary Examiner* — Kristina R Fulton
*Assistant Examiner* — Thomas L Neubauer
(74) *Attorney, Agent, or Firm* — Quarles & Brady LLP

(57) ABSTRACT

A side door of a motor vehicle has a door lock actuator for a door lock, and a pivoting lever pivotable about a rotational axis of a joint. The pivoting lever has a coupling section coupled to a mechanical actuating member of the door lock in the installed state. An interior door pull handle has one or more fastening regions and at least one handle region having an axial extent. The pivoting lever is integrated into the handle region of the interior door pull handle. The rotational axis is oriented substantially transversely with respect to the axial extent.

15 Claims, 5 Drawing Sheets

Figure 1:
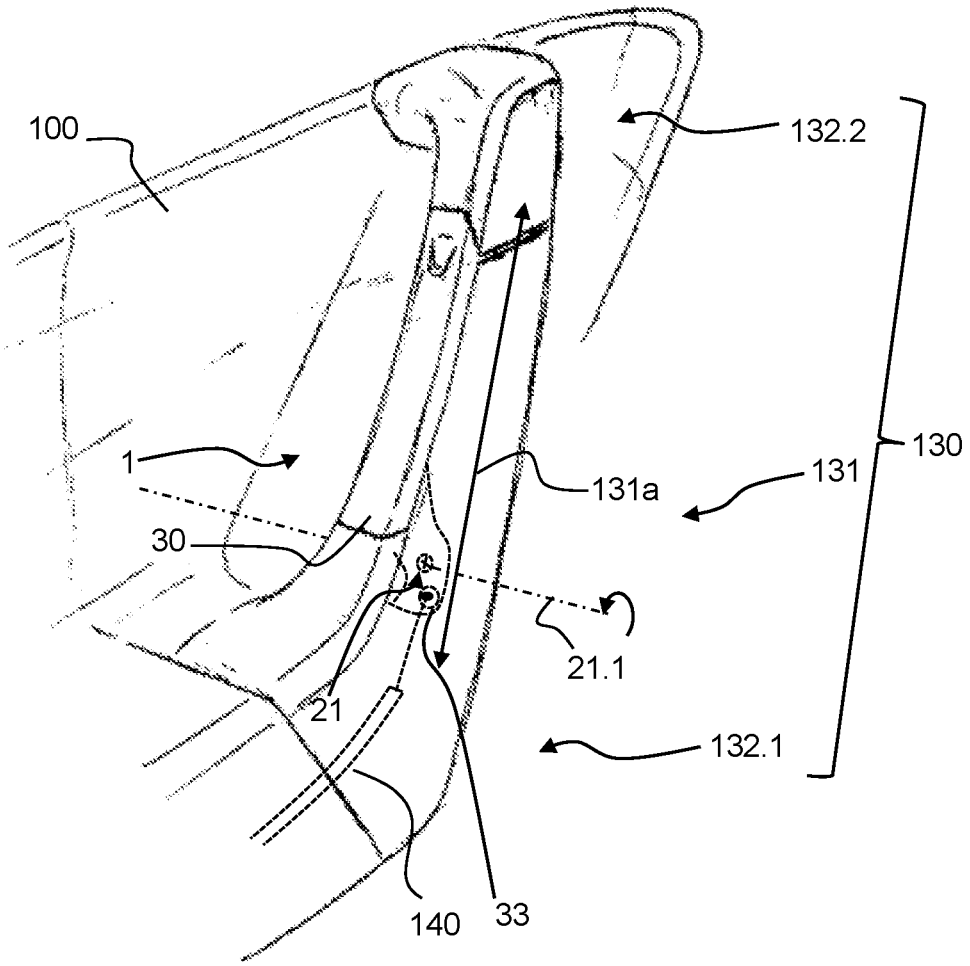

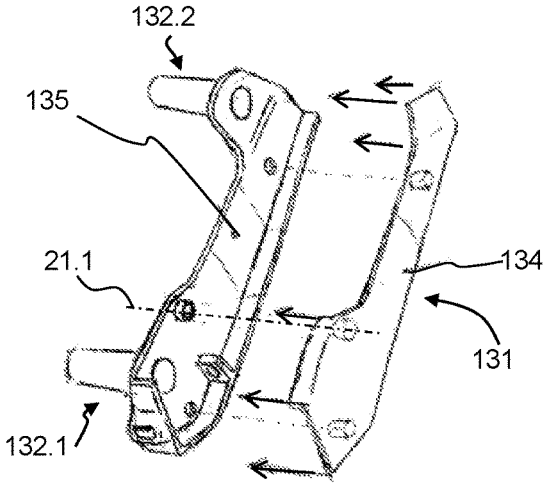
Fig. 6c
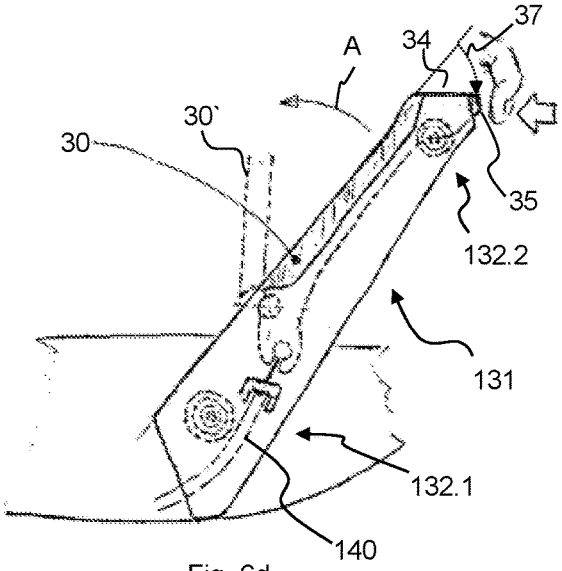
Fig. 6d
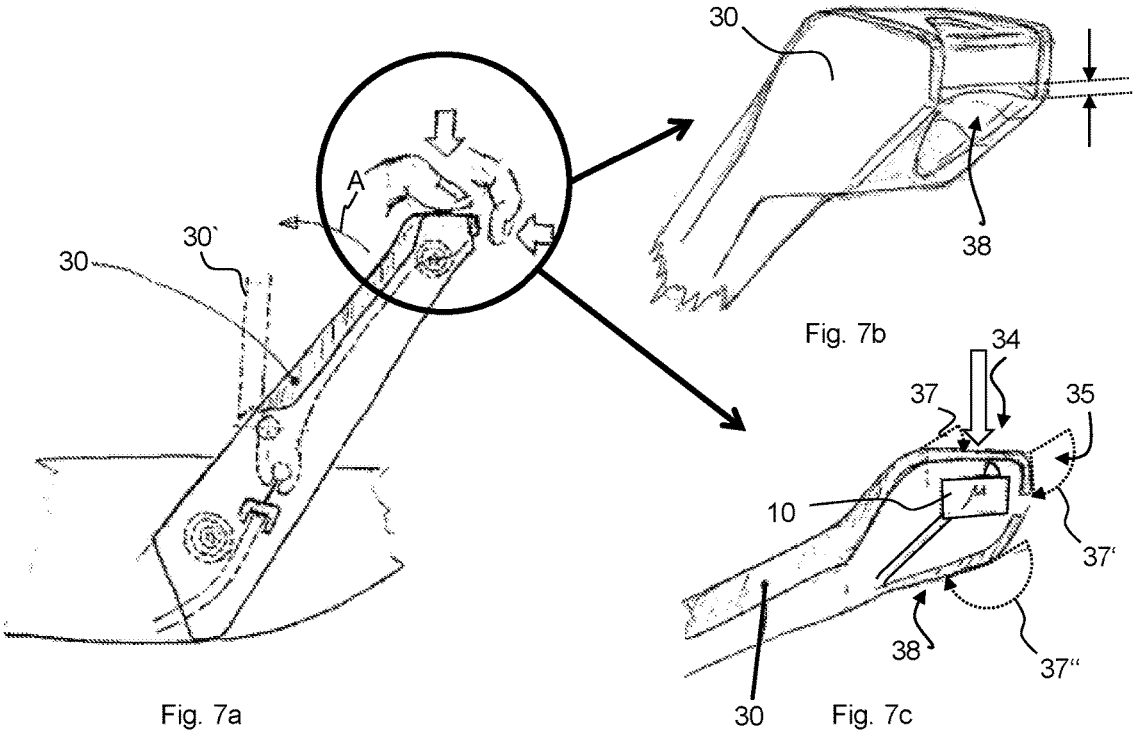
Fig. 7a
Fig. 7b
Fig. 7c

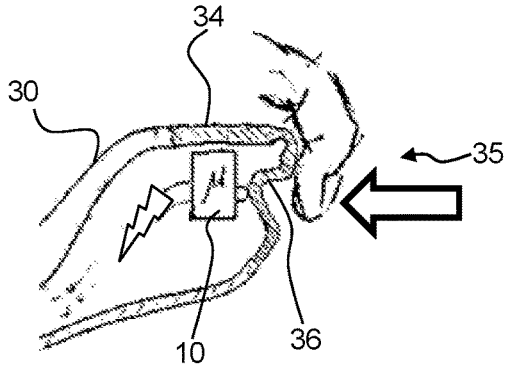
Fig. 8a
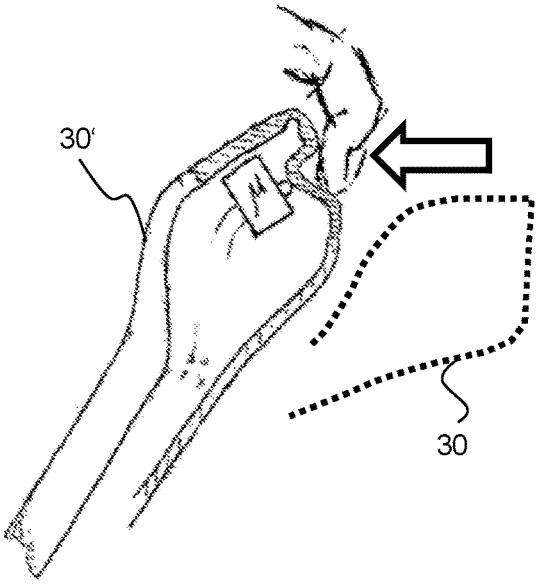
Fig. 8b
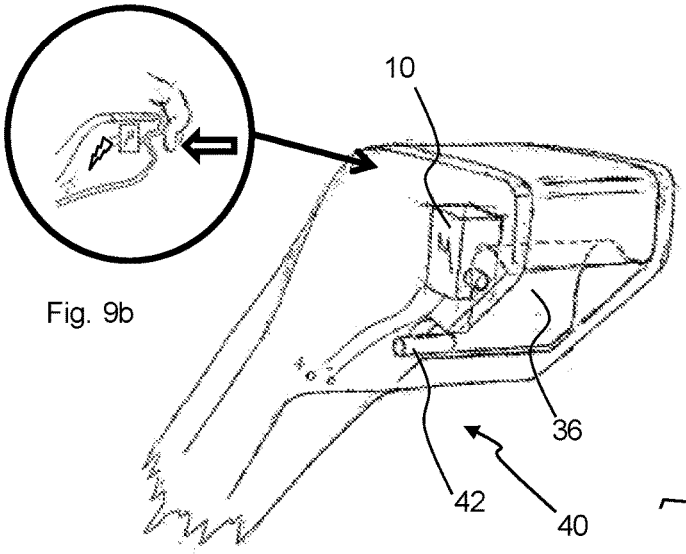
Fig. 9b
Fig. 9a
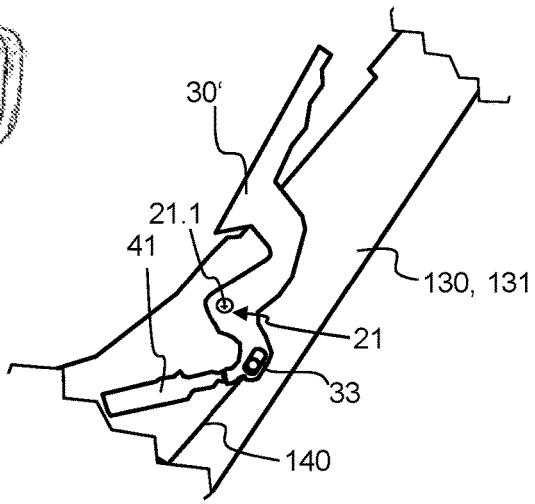
Fig. 10

INTERIOR DOOR LOCK OPERATOR INTEGRATED INTO PULL DOOR HANDLE

RELATED APPLICATIONS

The present application claims priority to German Patent Application Number 10 2016 103 897.0, filed Mar. 3, 2016, the disclosure of which is hereby incorporated by reference herein in its entirety.

The invention relates to improvements for door lock actuators of a motor vehicle door, in particular for the door lock actuation of a motor vehicle door from the interior.

An interior door handle 6Q0837174 from the VW Polo IV (FIG. 2) is known from the prior art, which interior door handle combines an interior door pull handle and a door lock actuator as one module. Although it provides pleasant esthetics and is compact, the inventors have set the object of improving it even further. The object is achieved by way of the independent claims. Advantageous developments are defined in the subclaims.

In particular, the object is achieved by way of a side door of a motor vehicle, the side door having:

- a door lock actuator for a door lock, the door lock actuator preferably being an interior door actuator, and the door lock actuator having a pivoting lever which is mounted such that it can be pivoted about a rotational axis of a joint, the pivoting lever having a coupling section for a mechanical actuating means of the door lock, to which the mechanical actuating means is coupled in the installed state.

Furthermore, the object is achieved, in particular, by way of a door lock actuator which is described here.

Furthermore, the object is achieved, in particular, by way of a module for a side door of a motor vehicle consisting of a door lock actuator which is described here and an interior door pull handle which is described here.

Furthermore, the object is achieved, in particular, by way of the use of a module according to the invention or door lock actuator according to the invention for a side door of a motor vehicle.

In a further exemplary embodiment of the present invention, the side door has:

- an interior door pull handle (or door holding handle) with one or more fastening regions and with at least one handle region which can be reached behind with a hand, preferably can be reached around completely over 360°, the handle region having an axial extent;
- the pivoting lever being integrated into the handle region of the interior door pull handle, the rotational axis being oriented substantially transversely with respect to the axial extent.

As a result of the orientation of the pivoting axis of the pivoting lever transversely with respect to the axial extent of the handle region, which orientation is not customary, in particular, in passenger motor vehicles, it is possible to integrate the pivoting lever in a space-saving manner directly into the handle region of the interior door pull handle, and not above it, and in the process at the same time to obtain a long lever arm, however. Therefore, an arrangement which saves more space with best functionality has been obtained.

The motor vehicle is preferably a passenger motor vehicle. In the following text, reference is made in part to the vehicle coordinate system, the X-direction being directed forward in the driving direction, the Z-direction being directed upward and the Y-direction being directed transversely with respect to the X-direction from the front passenger to the driver.

An actuation of the door lock is understood to mean, for example, the opening/closing of the door catch and/or the locking/unlocking.

The mechanical actuating means preferably permits a purely mechanical actuating option of the door lock, by means of which actuating option the door lock can be unlocked and/or the door latch can be opened, with the result that the door can be pivoted open. The door lock actuator is preferably set up to carry out the mechanical actuation completely without power, with the result that this type of actuation can also be used in the case of an emergency without on-board power. The mechanical actuating means has, for example, a Bowden cable and/or a mechanism and/or a linkage.

The coupling section on the pivoting lever is preferably a connecting point, via which a pivoting movement of the pivoting lever can be transmitted to the mechanical actuating means; for example, an opening or a fork or a hook. A freewheel is preferably arranged between the pivoting lever and the door lock. By means of a device which is called a freewheel here, the pivoting lever can be actuated over a limited pivoting range without forwarding the actuation in the process to the door lock and/or the mechanical actuating means. For example, the coupling region has a slot guide for the Bowden cable nipple as freewheel.

The pivoting lever is preferably the operating element, by means of which a user operates the mechanical actuating means. It preferably has a rest position and a mechanism actuating position, in which the door lock is actuated mechanically.

The pivoting lever preferably has a stowed position and a protruding position. In the stowed position, the pivoting lever preferably merges in a flat and flush manner all the way around or in a flat and flush manner apart from a recessed handle into the surfaces which adjoin it, for example the surfaces of the handle region. The pivoting lever can preferably be gripped by the hand in the protruding position or can be gripped better than in the stowed position. The stowed position and the protruding position are preferably defined by means of a mechanism (e.g. the locking device) in such a way that they, provided they have been assumed, are stable positions in which the pivoting lever, provided no additional active force (e.g. manual pushing/pulling, electrically generated force) has been applied to it, remains.

The pivoting lever can preferably be pivoted with respect to the handle region. A part of the handle region preferably exists which is connected fixedly to the side door so as to rotate with it.

In one alternative embodiment, the pivoting lever can be pivoted with the handle region and/or the handle region or an axial region of the handle region itself forms the pivoting lever or the pivoting lever itself forms the handle region, the pivoting lever preferably forming a complete handle region at least in an axial section of the handle region. Here, a locking device as will still be mentioned in the following text is preferably provided, which locking device fixes the handle region, in the normal case against at least pivoting movements, or restricts the possible pivoting movement or restricts it to a more pronounced extent in comparison with the state with a released locking device, and pivoting of the handle region and/or pivoting lever for mechanical actuation of the door lock is possible only when the locking device is released. Here, the pivoting lever is preferably configured as a handle with two connecting points, of which one can be released by means of the locking device.

The pivoting lever which is integrated into the handle region and the handle region preferably form the only interior door pull handle which is provided for holding firmly and/or pulling the door closed, with a handle region which can be gripped around by 360°, preferably any single interior door pull handle.

The interior door pull handle is preferably formed by way of at least one outer grip plate and one inner grip plate. Here, the pivoting lever is preferably mounted such that it can be pivoted between the two grip plates. The direction of the axial extent is preferably the longitudinal direction of the interior door pull handle, that is to say, during normal gripping of the handle region, the direction of the axial extent is transverse with respect to the fingers of the gripping hand. The dimension of the axial extent of the handle region is preferably measured by way of the shortest free section on the door trim surface between the attaching points of the interior door pull handle. The interior door pull handle preferably has a lower end and an upper end. It is preferably an interior door pull handle which is arranged diagonally (obliquely toward the front; toward the front being the positive X-direction of the vehicle coordinate system). The upper end is preferably further toward the front than the lower end. The lower end preferably merges into an arm support region, preferably in a flat and flush manner. The interior door pull handle is preferably configured in the form of a handle with attaching points to the side door in two different fastening regions and the handle section in between. The pivoting lever preferably has a longitudinal extent in the lever direction. The longitudinal extent is preferably measured from the rotational axis as far as the distal end of the pivoting lever. The longitudinal extent of the pivoting lever is preferably greater than the transverse extent of the interior door pull handle. The pivoting lever preferably overlaps the handle region with at least 50% of its longitudinal extent and/or at least 50% (for example 50-60% or 80%) of the longitudinal extent of the handle region overlaps the longitudinal extent of the pivoting lever.

The rotational axis is preferably oriented substantially parallel to the roadway plane or the vehicle floor and transversely with respect to the straight-ahead driving direction of the motor vehicle, that is to say parallel to the Y-direction.

The door lock actuator preferably has a spring which prestresses the pivoting lever counter to direction A (pivoting direction of the pivoting lever for mechanical actuation of the door lock) in direction B (pivoting direction which is opposed to A); this is preferably a separate spring from a spring which is possibly present in the door lock or from another spring which is present in the door lock actuator.

The expression "substantially" in conjunction with directional relationships or angular relationships (such as "transverse", or "same direction") is preferably generally understood to be a tolerance range of ±30°, preferably ±15°, particularly preferably ±5°. The addition "substantially" can particularly preferably also be deleted, with the result that reference is made to the exact directional relationship or angular relationship.

In a further exemplary embodiment of the present invention, the pivoting lever extends into at least one of the fastening regions and defines a surface there which is bent or curved by an angle in the range from 30° to 225° with respect to the pivoting lever, and preferably is accessible by hand in the rest position of the pivoting lever.

As a result, the pivoting lever can be operated manually in an improved manner. Surfaces are provided which can be made contact with in a frictionally locking or positively locking manner by one or more fingers, in order to pull the pivoting lever, in particular, in direction A. A surface which is bent or curved around the handle region is preferably a surface section, the surface normal of which encloses said angle with the surface normal in the handle region. The bending axis of the bend or the curvature axis of the curvature which connects said surface to the pivoting lever in the handle region is preferably parallel to the rotational axis.

In a further exemplary embodiment of the present invention, the pivoting lever forms an upper side in a fastening region. As a result, the pivoting lever can be pressed or pulled by way of contact from above.

In a further exemplary embodiment of the present invention, the pivoting lever forms a front side at the end of the upper side, which front side preferably forms an overhang, the overhang preferably forming a finger recess for from one to three, preferably two fingers, which front side can be hooked into by means of one or more fingers of a hand. As a result, the pivoting lever can be pulled in a positively locking manner by one or more fingers.

In a further exemplary embodiment of the present invention, the door lock actuator has an inertia compensation spring which prestresses the pivoting lever counter to a pivoting direction of the pivoting lever for actuating the mechanical actuating means, said spring loading the pivoting lever directly or indirectly only when the latter has been moved from a stowed position into a protruding position.

As a result, it is possible to keep the actuating forces which are required to move the pivoting lever from a stowed position into a protruding position as small as possible, and at the same time to adhere to the requirements, required, for example, in the case of a rear impact, of an unintended mechanical door lock actuation as a result of inertia. The inertia compensation spring preferably does not load the pivoting lever between the stowed position and the protruding position. The door lock actuator preferably has a second spring, for example the abovementioned spring, which prestresses the pivoting lever counter to direction A (pivoting direction of the pivoting lever for the mechanical actuation of the door lock) in direction B (pivoting direction opposed to A), at least between the stowed position and the protruding position. The restoring force of said spring is preferably smaller than that of the inertia compensation spring.

In particular, this exemplary embodiment can preferably be considered to be an independent invention which can then be pursued in a separate application, it not being absolutely necessary for the door lock actuator to be an interior door actuator and it also not being absolutely necessary for an internal door pull handle (or door holding handle) to be present, into which the pivoting lever is integrated. Otherwise, however, the features mentioned here can also be applied as optional and preferred features.

In a further exemplary embodiment of the present invention, the door lock actuator has a push-push element which is set up, as a consequence of a pressure on the pivoting lever, to pivot the latter into a protruding position which can be gripped by the hand or can be gripped in an improved manner with regard to a stowed position of the pivoting lever. As a result, the pivoting lever can be brought forward comfortably for use, with the result that it can be gripped in an improved manner and can be actuated more comfortably. The push-push element is preferably a non-locking push-push element, particularly preferably a locking push-push element, that is to say a locking device.

In a further exemplary embodiment of the present invention, the push-push element is arranged in a lower half of the interior door pull handle, preferably the handle region. As a result, a pleasing design of an upwardly tapering internal door pull handle can be realized technically, since the component which requires installation space is displaced downward.

In a further exemplary embodiment of the present invention, the door lock actuator has a locking device which can preferably be unlocked by means of a manual unlocking movement and by means of which a preferably positively locking locking action of the pivoting lever with respect to a movement in the direction of the actuation of the mechanical actuating means is provided.

As a result, the actuating means is secured against unintended actuation. The pivoting lever is preferably held in its rest position by way of the locking device. The locking action is preferably positively locking and/or non-positive and/or magnetic or electromechanical. That is to say, a locking action does not necessarily presuppose a positively locking "bolt", but rather a locking action by means of a retaining force maximum is also possible, which retaining force maximum has to be overcome in order to move the pivoting lever in the direction of the actuation of the mechanical actuating means, the force which is necessary for the further movement of the pivoting lever in the direction of the actuation of the mechanical actuating means at least first of all being smaller again, after the holding force maximum is overcome, than the retaining force maximum. The user perceives a locking action of this type, for example, as a snapping-in action of the pivoting lever into the locked position and an unlocking action as a snapping-out action out of the locked position into the unlocked position. A locked position of the pivoting lever is preferably a stowed position, preferably a stowed position which is substantially flat and flush (with a possible remaining recessed grip). In a further exemplary embodiment of the present invention, the locking device has two springs which are stressed in an antagonistic manner with respect to one another and the rest position of which defines at least one protruding position of the pivoting lever.

This is a mechanically advantageous variant, in order to define the protruding position of the pivoting lever.

A rest position is preferably a position, in which the amount of the sum of the spring forces is smaller than the frictional and/or adhesive forces of the pivoting lever mounting, or in which the pivoting lever remains without an additional external or active action of force; this can therefore also be a rest position region.

In particular, this exemplary embodiment can preferably be considered to be an independent invention which can then be pursued in a separate application, it not being absolutely necessary for the door lock actuator to be an interior door actuator and it also not being absolutely necessary for an internal door pull handle (or door holding handle) to be present, into which the pivoting lever is integrated. Otherwise, however, the features mentioned here can also be applied as optional and preferred features.

In one variant which builds on this, the locking device has, for example, a blocking element which blocks the pivoting lever in the stowed position. If said blocking element is released (for example, by way of manual pressing onto a pressure surface), the spring imbalance of the two springs which are prestressed in an antagonistic manner brings about a movement of the pivoting lever into the protruding position, in which the spring equilibrium prevails. Another variant is, for example, the following further exemplary embodiment.

In a further exemplary embodiment of the present invention, one of the springs is a catch spring, and the other spring is preferably a linear spring, the catch spring, together with the other of the two springs which are stressed with respect to one another, defining a second rest position which defines a stowed position of the pivoting lever.

As a result, the stowed position is defined as a stable and locked position even without the necessary presence of a blocking element of the locking device. A catch spring is preferably understood to mean a spring with a non-linear spring characteristic, preferably with at least one extreme value or saddle point. For example, this is a catch disk or what is called a "Knackfroschfeder" [clicker spring] in German language use. The catch spring preferably has two extension regions which are separated from one another by an extreme value or saddle point or discontinuity point (in general: snap-over point). A first region runs from the relieved state of the catch spring as far as the snap-over point, and a second region runs further from there as far as the maximum extension of the catch spring. The catch spring preferably loads the pivoting lever in direction A, that is to say it presses it from the stowed position into the protruding position; the other spring therefore loads the pivoting lever in direction B. In the protruding position, the catch spring is preferably relieved or it is situated in the first region of the catch spring. The snap-over point of the catch spring is assumed when the pivoting lever is situated between the protruding position and the stowed position. In the stowed position, the catch spring is preferably situated in the second region and forms a rest position with the other spring. The rest position can be secured additionally by way of a blocking element.

In a further exemplary embodiment of the present invention, the locking device has a latching element which is situated in a latched position in a defined angular position or a defined angular region of the pivoting lever, preferably one or two from the positions of stowed position and protruding position, it being possible for the latched position

- to be left by way of a predefined pivoting moment being overcome in at least the direction of the actuation of the mechanical actuating means, and/or
- to be left by way of manual, direct or indirect tensioning, that is to say preferably setting (further) under stress, of a spring element.

One preferred embodiment of the locking device is provided as a result. The provision of a latching element, the latched position of which can be left by means of a predefined pivoting moment being overcome, is one advantageous embodiment with regard to panic-proofing. A spring element is generally understood to mean a flexibly deformable, restoring element. The latching element is preferably a latching web. In its latched position and the rest position of the pivoting lever, it preferably lies on a blocking contour on a part which is stationary with respect to the pivoting lever 30.

In a further exemplary embodiment of the present invention, the locking device has the push-push element, and the push-push element has the latching element, the push-push element blocking the pivoting lever in a blocked state, preferably at least from a defined pivoting angle, against a pivoting movement in the direction of a door lock actuation by means of the mechanical actuating means, and being released by way of a movement of the pivoting lever in a direction which is opposed to the movement in the direction of the door lock actuation by means of the mechanical actuating means, with the result that the actuation of the door lock by means of the mechanical actuating means is possible and/or a movement of the pivoting lever from a stowed position into a protruding position is possible.

As a result, one advantageous combination of a pivoting-out mechanism, which facilitates the gripping of the pivoting lever, and a locking device is provided. The movement of the pivoting lever in direction B preferably takes place by way of manual pressing of the pivoting lever against a spring element.

In a further exemplary embodiment of the present invention, the door lock actuator has a manually actuable electric switch which is connected to the door lock via a signal line, with the result that the door lock can be actuated electrically by way of the switch.

As a result, a second possibility of the door lock actuation is provided. The door lock actuator is preferably set up to actuate the door lock in the normal case via a switch actuation and, in the case of an emergency, via the mechanical actuation.

A signal line is preferably a line for transmitting a switching signal, whether physically line-bound or wireless. For example, the signal line is a cable or a radio link. Here, the signal line can comprise different nodes or switching/preparing/processing points (digital or analog), for example a central control unit, and sections with the various transmission media.

A switch is preferably understood to mean an electromechanical arrangement which is set up to generate an electric switching signal, which particularly preferably, for example, can be a microswitch. However, sensor-supported switching arrangements with a sensor (for example, Hall sensor) and an evaluation unit (for example, microcontroller, comparator) are also conceivable. An actuation of the switch is preferably understood to mean the movement of the switch from one switching state into the other switching state. The switch can preferably be actuated by means of a pivoting movement of the pivoting lever, for example in direction B. The switch is preferably covered by a flexible wall which can be pressed in manually, in order to actuate the switch. The switch is preferably integrated into the pivoting lever, preferably in the distal third, preferably quarter, particularly preferably end of the pivoting lever. For example, the switch can be actuated behind a flexible wall, preferably a front side or upper side, of the pivoting lever with a deformation of said wall. As an alternative, however, an (uncovered) push-button is also conceivable instead of a flexible wall.

In a further exemplary embodiment of the present invention, a movement direction for actuating the switch and a movement direction for actuating the mechanical actuating means are substantially identical.

This is advantageous with regard to panic-proofing. The user, if he/she wishes to open the door mechanically in the case of an emergency, can thus fall back on the movement pattern which he/she is used to during the door lock actuation by means of the switch. The switch is preferably necessarily actuated previously when carrying out mechanical actuation.

In particular, this exemplary embodiment can preferably be considered to be an independent invention which can then be pursued in a separate application, it not being absolutely necessary for the door lock actuator to be an interior door actuator and it also not being absolutely necessary for an internal door pull handle (or door holding handle) to be present, into which the pivoting lever is integrated. Otherwise, however, the features mentioned here can also be applied as optional and preferred features.

In a further exemplary embodiment of the present invention, the locking device can be unlocked by means of a manual unlocking movement, and a movement direction for actuating the switch and a direction of the unlocking movement are substantially identical.

This is advantageous with regard to panic-proofing if a locking device is present. The switch is preferably necessarily actuated before or at the same time as the unlocking action when the unlocking movement is carried out.

In particular, this exemplary embodiment can preferably be considered to be an independent invention which can then be pursued in a separate application, it not being absolutely necessary for the door lock actuator to be an interior door actuator and it also not being absolutely necessary for an internal door pull handle (or door holding handle) to be present, into which the pivoting lever is integrated. Otherwise, however, the features mentioned here can also be applied as optional and preferred features.

In a further exemplary embodiment of the present invention, the door lock actuator has a pressure mechanism in addition to the pivoting lever, the pressure mechanism being set up to deflect a manual pressure force, which acts on said pressure mechanism, onto the pivoting lever in the direction of the actuation of the mechanical actuating means.

As a result, the pivoting lever can be moved by means of a manual pressure force in the direction of the actuation of the mechanical actuating means, for example in order to move the pivoting lever by means of a pressure force out of the stowed position which is preferably substantially flat and flush into the protruding position.

The pressure mechanism preferably has a touch surface which can be manually pressed directly, for example as part of the rocker which is mentioned in the following text or coupled to the rocker via a touch surface coupling section. The touch surface is preferably arranged directly adjacently with respect to the pivoting lever and/or likewise integrated into the handle region of the interior door pull handle. The pressure mechanism is preferably a purely mechanical mechanism which couples the touch surface to the pivoting lever. The pivoting lever can be pressed out actively by means of the pressure mechanism, with the result that it can be gripped. The pressure mechanism is preferably mounted on its own in relation to the vehicle door, preferably the interior door pull handle. The pivoting lever can preferably be moved separately with respect to the pressure mechanism.

The pressure mechanism preferably has a rocker. The rocker is preferably mounted such that it can be rotated about a rocker axis. The rocker axis is preferably parallel to the pivoting axis of the pivoting lever. The rocker preferably has a pivoting lever coupling section. The latter is preferably arranged such that it is rotated about the rocker axis by at least 90°, preferably 180°, with regard to the touch surface or the touch surface coupling section. The rocker axis preferably lies between the touch surface or the touch surface coupling section and the pivoting lever coupling section. The pivoting lever coupling section preferably bears against the pivoting lever at least in certain pivoting lever/rocker positions, and is set up to transmit a rotation of the rocker about the rocker axis to the pivoting lever, with the result that the pivoting lever pivots in the direction of the actuation of the mechanical actuating means.

The rocker or, if present, the touch surface which is coupled to the rocker, if the manually actuable electric switch is present, is preferably set up to actuate said switch directly or indirectly as a consequence of a pressure on the touch surface (separately or as part of the rocker) and the resulting movement of the touch surface. The rocker preferably does not yet bear against the pivoting lever in the pivoting region which is required for actuating the switch, with the result that no deflection of the pressure force onto the pivoting lever takes place yet during a switch actuation. The rocker is preferably set up to move the pivoting lever in the direction of the actuation of the mechanical actuating means during a movement of the touch surface which goes beyond the movement for actuating the electric switch. Thus, the switch can be actuated by light/normal pressing, and the pivoting lever is provided, for example, into the protruding position by way of pronounced pressing.

The rocker is preferably prestressed into a rest position by means of a spring. The other spring end of a spring which also prestresses the pivoting lever in direction B into a rest position preferably loads the rocker, with the result that only one spring is necessary, in order to keep the pivoting lever and rocker in their rest position. The rest position of the rocker is preferably such that the touch surface (separate or as part of the rocker) merges in a flat and flush manner into the surfaces which adjoin it, preferably the surfaces of the handle region and/or the pivoting lever.

The pressure mechanism is preferably coupled to the latching element of the locking device (insofar as there is a locking device with latching element), the pressure mechanism being set up to release the latching element when the pressure mechanism is pressed as far as beyond a certain point, for example when the switch is present, is pressed further than is necessary for actuating the switch.

In particular, this exemplary embodiment can preferably be considered to be an independent invention which can then be pursued in a separate application, it not being absolutely necessary for the door lock actuator to be an interior door actuator and it also not being absolutely necessary for an internal door pull handle (or door holding handle) to be present, into which the pivoting lever is integrated. Otherwise, however, the features mentioned here can also be applied as optional and preferred features.

In a further exemplary embodiment of the present invention, the pivoting lever, preferably in the stowed position, merges all the way around in a flat and flush manner into the surfaces of the handle region which adjoin it.

This results in a pleasing and ergonomic design, since the internal door pull handle can be gripped pleasantly when it is used in its pulling-closed or holding function. Surfaces are preferably understood to mean visible surfaces.

In a further exemplary embodiment of the present invention, the pivoting lever, preferably in the stowed position, merges in a flat and flush manner into the surfaces of the handle region which adjoin it, apart from an engagement recess, preferably for one, two or three fingers.

This results in a pleasing and ergonomic design, since the internal door pull handle can be gripped pleasantly when it is used in its pulling-closed or holding function. In addition, however, the pivoting lever can be manually moved relatively comfortably out of its rest position, even without a push-push element or bent/curved surfaces, from where it can then be gripped in an even more improved manner by a hand. Surfaces are preferably understood to mean visible surfaces.

Figure 2:
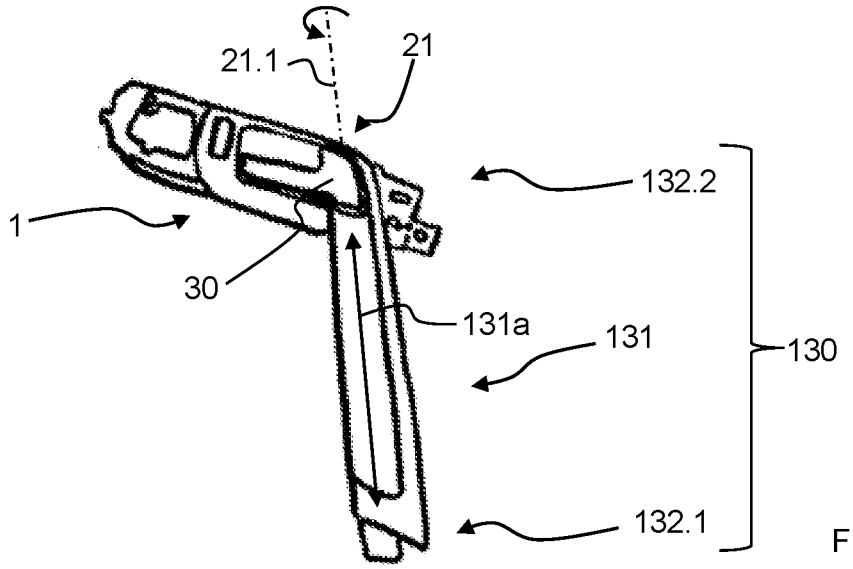
Prior Art Fig. 2
Figure 3:
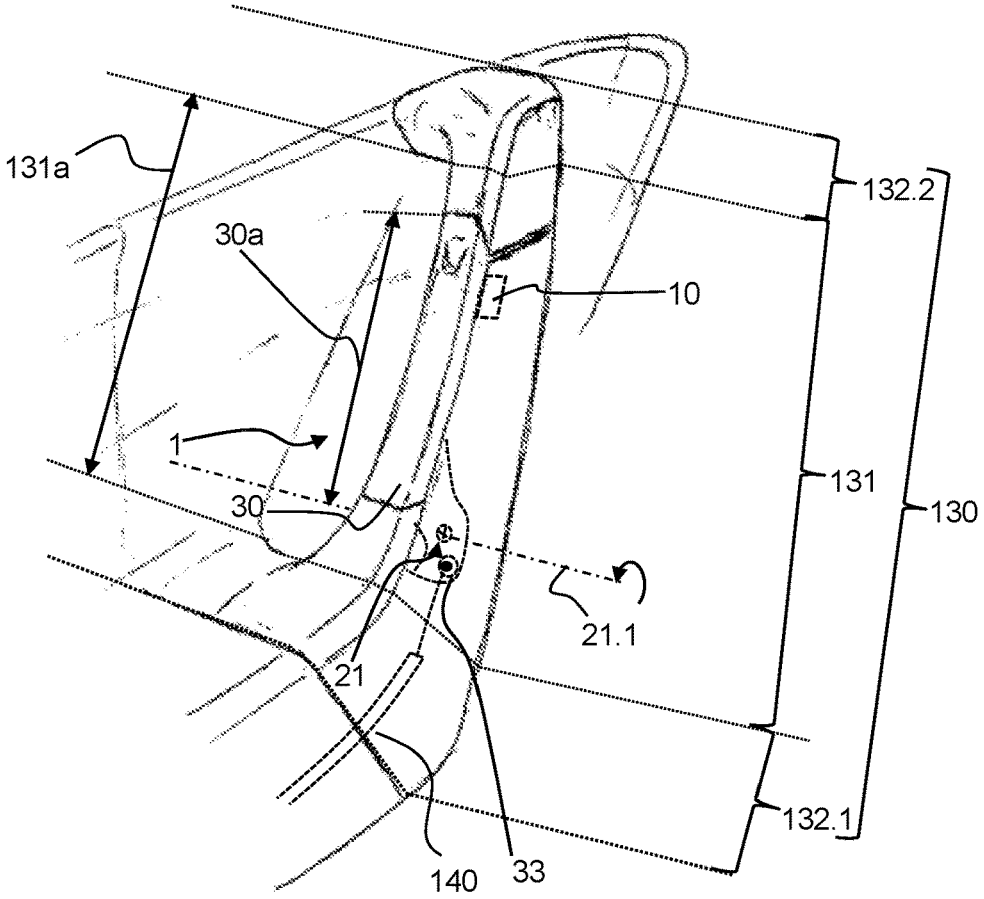
Figure 4A:
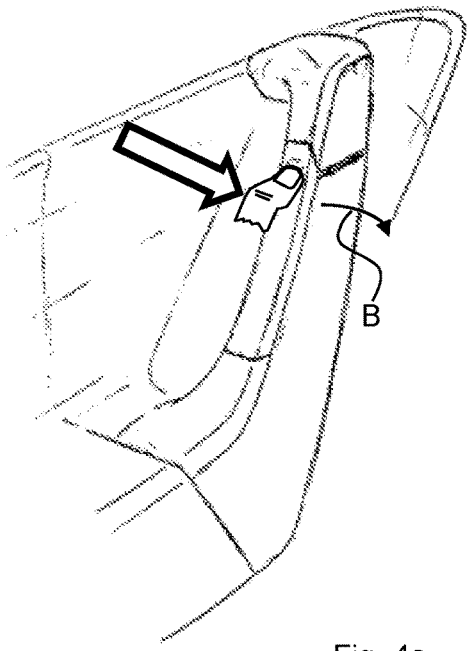
Figure 4B:
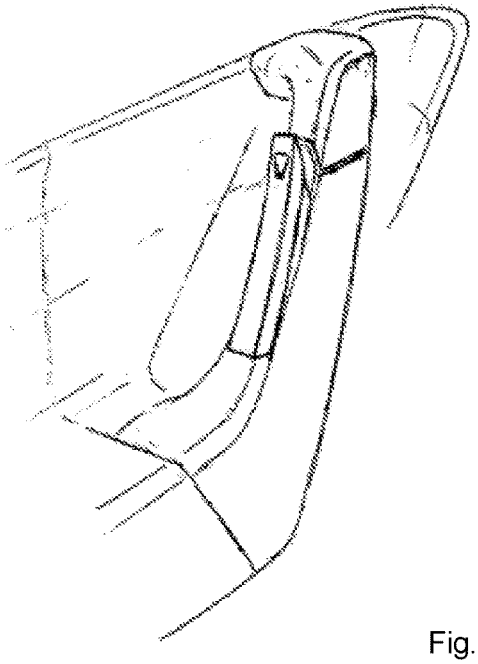
Figure 4C:
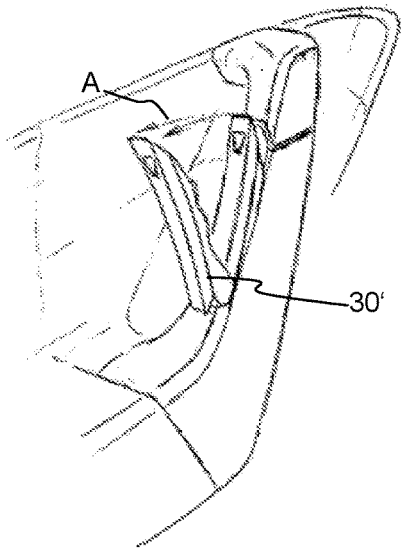
Figure 5:
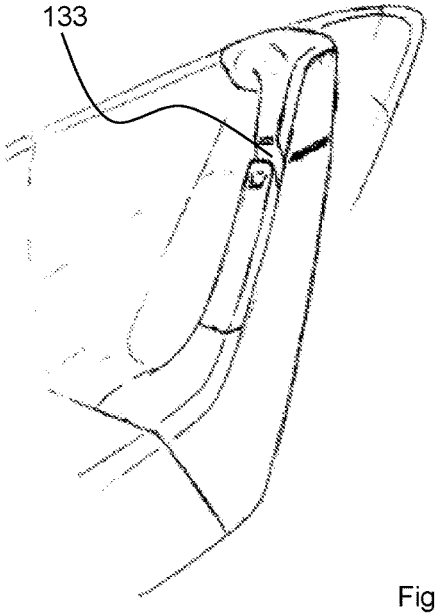

The invention is now to be illustrated further by way of example using outline drawings, in which:

FIG. 1 shows a perspective view of a detail of a side door according to the invention having a module according to the invention with a door lock actuator and an interior door pull handle, FIG. 2 shows a perspective view of a module having a door lock actuator and an interior door pull handle from the prior art, FIG. 3 shows a perspective view of one embodiment of the invention based on FIG. 1, there additionally being a switch, FIGS. 4*a*-4*c* show perspective views of different operating states of the invention, based on FIG. 1 and FIG. 3, FIG. 5 shows a perspective view of a further embodiment of the invention based on the preceding figures with an engagement recess, FIGS. 6*a*-6*d* in each case show details of perspective views (FIGS. 6*a*-6*c*) and a sectional view (FIG. 6*d*) of a further embodiment of the invention based on FIG. 1, FIGS. 7*a*-7*c* in each case show details of sectional views (FIGS. 7*a*, 7*c*) and a perspective view (FIG. 7*b*) of one embodiment of the invention based on FIGS. 6*a*-6*d*, there additionally being a switch, FIGS. 8*a*-8*b* in each case show details of sectional views of one variant of an embodiment of the invention as shown in FIGS. 7*a*-7*b*, FIGS. 9*a*-9*b* in each case show details of a perspective (FIG. 9*a*) and sectional (FIG. 9*b*) illustration of one embodiment based on FIGS. 8*a*-8*b*, one example of a locking device (40) additionally being shown, FIG. 10 shows an outline illustration of the positioning of a push-push element based on FIG. 1, and FIGS. 11*a*-11*c* shows an outline illustration of a door lock actuator having an additional pressure mechanism in different states based on FIG. 1.

FIG. 1 shows a perspective view of a detail of a side door 100 according to the invention of a motor vehicle having a module according to the invention with a door lock actuator 1 and an interior door pull handle 130. The side door has:

- a door lock actuator 1 for a door lock, the door lock actuator 1 being an interior door actuator and having a pivoting lever 30 which is mounted such that it can be pivoted about a rotational axis 21.1 of a joint 21, the pivoting lever 30 having a coupling section 33 for a mechanical actuating means 140 of the door lock, to which coupling section 33 the mechanical actuating means 140 (here, a Bowden cable) is coupled in the installed state,
- an interior door pull handle 130 having preferably two fastening regions 132.1, 132.2 here and having a handle region 131 which can be reached behind by a hand, can be reached around completely over 360° here, the handle region 131 having an axial extent 131*a*. The pivoting lever 30 is integrated into the handle region 131 of the interior door pull handle 130, the rotational axis 21.1 being oriented transversely with respect to the axial extent 131*a*. The pivoting lever 30 preferably has a longitudinal extent 30*a* in the lever direction.

FIG. 2 shows a perspective view of a module having a door lock actuator 1 and an interior door pull handle 130 from the prior art, in which module the pivoting lever 30 is not integrated into the handle region 131 of the interior door pull handle 130 and, in addition, the rotational axis 21.1 is not oriented transversely with respect to the axial extent 131*a*.

FIG. 3 shows a perspective view of one embodiment of the invention based on FIG. 1, there additionally being a switch 10. The electric switch 10 is connected via a signal line to the door lock, with the result that the door lock can be actuated electrically by way of the switch 10. In addition, the door lock actuator 1 has a push-push element 41 which (for example, as shown in FIG. 10) is arranged in a lower half of the interior door pull handle 130, here the handle region 131, and which is set up, as a consequence of a pressure on the pivoting lever 30, to pivot the latter into a position (see FIG. 4*b*) which can be gripped by a hand or can be gripped in an improved manner by a hand. In its rest position (see FIG. 1, FIG. 3*a*), the pivoting lever 30 merges all the way around in a flat and flush manner into the surfaces of the handle region 131 which adjoin it. The interior door pull handle 130 is fastened to the door 100 in a manner which runs obliquely from the front at the top. In addition, auxiliary lines are illustrated which preferably help to differentiate the different regions 132.1, 131, 132.2 of the interior door pull handle 130 from one another. The longitudinal extent 30*a* is preferably measured from the rotational axis 21.1 as far as the distal end of the pivoting lever 30. The axial extent 131*a* of the handle region 131 is preferably measured by way of the shortest free path on the door trim surface between the attaching points of the interior door pull handle 130. The pivoting lever 30 overlaps the handle region 131 with 100% of its longitudinal extent 30*a*. Approximately 80% of the longitudinal extent 131*a* of the handle region 131 overlaps with the pivoting lever 30. Here, the switch 10 can preferably be actuated by means of pivoting of the pivoting lever 30 in direction B.

The push-push element can preferably be part of a locking device 40, with the result that the push-push element not only causes the pivoting lever 30 to pivot outward but rather also blocks the pivoting lever 30 with respect to a movement A for mechanical door lock actuation in a blocked state. In this case, the door lock actuator 1 which is shown here has a locking device 40 which can be unlocked by means of a manual unlocking movement and by means of which a preferably positively locking locking action of the pivoting lever 30 with respect to a movement in direction A of the actuation of the mechanical actuating means is provided. The locking device 40 has a latching element which is situated in a latched position in a certain angular position or a certain angular range of the pivoting lever 30, it being possible for the latched position to be left by way of manual indirect stressing of a spring element which is, for example, part of the push-push element 41. The locking device 40 has the push-push element 41. The push-push element 41 has the latching element. In a blocked position, the push-push element blocks the pivoting lever 30 with respect to a pivoting movement in direction A (see FIG. 4*c*) of a door lock actuation by means of the mechanical actuating means 140. The latching element is released by way of a movement of the pivoting lever 30 in a direction B (see FIG. 4*a*) which is opposed to the movement in direction A of the door lock actuation by means of the mechanical actuating means 140, which is initiated by way of manual indirect or direct pressing of the pivoting lever against the spring element, with the result that the actuation of the door lock is possible by means of the mechanical actuating means 140. The locking device 40 can be unlocked by means of the manual unlocking movement in direction B, and the movement direction for actuating the switch 10 is identical to said direction B. In addition, the switch 10 is necessarily actuated before or at the same time as the unlocking action when the unlocking movement is carried out.

FIG. 4*a*-4*c* show perspective views of different operating states of the invention, based on FIG. 1 and FIG. 3.

FIG. 4*a* shows how the switch 10 can be actuated by way of pressure (which is direct here, but a further operating element can also be connected in between) on the pivoting lever 30 in direction B, preferably in the vicinity of that end of the pivoting lever 30 which is distal from the axis 21.1. If a push-push element is integrated, the push-push element can be activated by way of further pressing from the switching point, with the result that it presses the pivoting lever 30 into a protruding position, in which the pivoting lever can be gripped at all or can at least be gripped in an improved manner compared with previously (that is to say, in particular, by way of pulling surfaces), which is shown in FIG. 4*b*. As an alternative, the pivoting lever 30 can be moved into the position which is shown in FIG. 4*b* manually (for example, by way of a manual clamping grip on both side surfaces or by means of a finger which engages into the engagement recess 133 which is shown in FIG. 5), with the result that the push-push element can also be dispensed with, depending on which form of comfort and operation is desired. In the position which is shown in FIG. 4*b*, the pivoting lever 30 can then be gripped by a hand satisfactorily and can be pulled further in direction A as far as into the position which is shown in FIG. 4*c* and in which the mechanical actuating means 140 actuates the door lock.

FIG. 5 shows a perspective view of a further embodiment of the invention based on the previous figures with an engagement recess 133. In its rest position which is shown here, the pivoting lever 30 merges in a flat and flush manner into the surfaces of the handle region 131 which adjoin it, apart from an engagement recess 133 for two fingers.

Figure 6B:
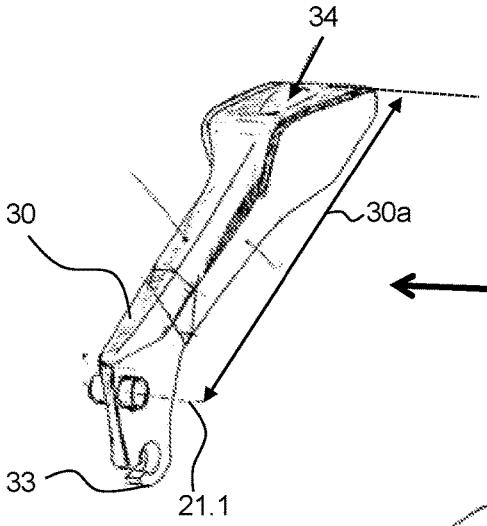
Figure 6A:
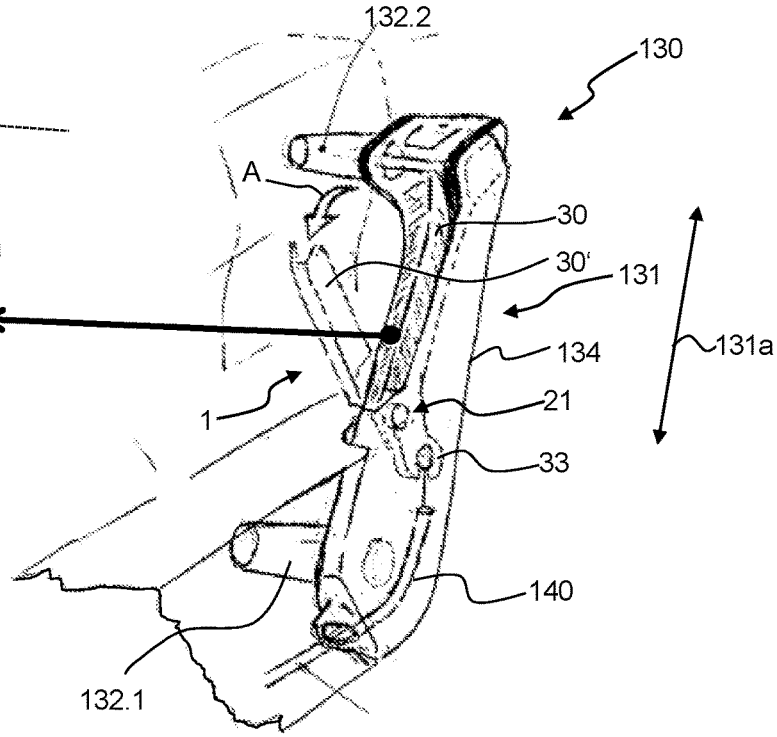

FIG. 6*a*-6*d* in each case show details of perspective views (FIGS. 6 *a*-6*c*) and a sectional view (FIG. 6*d*) of a further embodiment of the invention based on FIG. 1. The pivoting lever 30 extends into the fastening region 132.2. There, which is illustrated in conjunction with FIG. 7*c*, it defines surfaces 34, 35, 38 which are bent or curved by angles 37, 37', 37" in the range from 30° to 225° with respect to the pivoting lever 30 in the handle region 131, the angle 37 being approximately 30°, the angle 37' being approximately 135° and the angle 37" being approximately 190°. A push-push element as in FIG. 3 can also be present here. The pivoting lever 30 forms an upper side 34 in a fastening region 132.2. At the end of the upper side 34, it forms a front side 35 which forms an overhang and can be hooked into by means of one or more fingers of a hand, which is indicated in FIG. 6*d*. A finger recess 38 for from one to three, preferably two fingers is preferably formed below the overhang. The interior door pull handle 130 is formed by at least one outer grip plate 134 and one inner grip plate 135, the pivoting lever 90 being mounted there such that it can be pivoted between the two grip plates 134, 135. The position, in which the pivoting lever 30 actuates the mechanical actuating means for door lock actuator, is indicated in each case in a dashed manner by way of outline/detail and is marked with 30'. Since action surfaces are available for moving the pivoting lever 30 in direction A on account of the angled-away upper side 34 and, in particular, the front side 35 which is angled away yet further and/or also aided further by the finger recess 38 even without a push-push element, it is preferred if the pivoting lever 30 merges all the way around in a flat and flush manner into the surfaces of the handle region 131 which adjoin it.

FIGS. 7*a*-7*c* in each case show details of sectional views (FIGS. 7*a*, 7*c*) and a perspective view (FIG. 7*b*) of one embodiment of the invention based on FIGS. 6*a*-6*d*, there additionally being a switch 10. The manually actuable electric switch 10 is connected via a signal line to the door lock, with the result that the door lock can be actuated electrically by way of the switch 10. As shown in FIG. 7*a* and as can be seen from the section in FIG. 7*c*, the switch can be actuated in a particularly satisfactory manner via a pressure on the upper surface 34, it not being necessary in this embodiment for the pivoting lever 30 to be pivoted in direction B for this purpose, since the switch 10 can be pressed by means of a flexible upper wall of the pivoting lever. As an alternative, it is also conceivable that the switch 10 is arranged in such a way that the pivoting lever 30 is pivoted completely in direction B, in order to actuate the switch 10. The mechanical door lock actuation is produced, furthermore, via a pulling action on the front surface 35 and/or the finger recess 38, as shown in FIG. 7*a*.

FIGS. 8*a*-8*b* in each case show details of sectional views of one variant of an embodiment of the invention as shown in FIGS. 7*a*-7*b*. Here, the switch 10 is actuated by way of a pressure on the front surface 35 and/or the finger recess 38. The movement direction for actuating the switch 10 and the movement direction for actuating the mechanical actuating means 140 are substantially identical, since both the switch 10 can be switched (FIG. 8*a*) and the pivoting lever 30 can be pivoted back (FIG. 8*b*) by means of a manual force which is applied to the surface 35. The switch can be actuated behind a flexible wall 36 of the front side 35 of the pivoting lever 30 with deformation of said wall 36, but as an alternative an (uncovered) pushbutton is also conceivable.

FIGS. 9*a*-9*b* in each case show details of a perspective (FIG. 9*a*) and sectional (FIG. 9*b*) illustration of one embodiment based on FIGS. 8*a*-8*b*, one example of a locking device 40 being additionally shown. The door lock actuator 1 has the locking device 40 which can be unlocked by means of a manual unlocking movement. By means of said locking device 40, a preferably positively locking locking action of the pivoting lever 30 is provided with respect to a movement in direction A of the actuation of the mechanical actuating means. The locking device 40 has a latching element 42 which is situated in a latched position in a defined angular position or a defined angular range of the pivoting lever 30. Said latched position can be left by way of manual stressing of the flexible wall 36 which acts as a spring element. In its latching position (FIG. 9*a*) and the rest position of the pivoting lever 30, the latching element 42 (here, a latching web) bears with a blocking contour (not shown) at a part which is stationary with respect to the pivoting lever 30, for example against at least one of the grip plates 135, 135. The latching web therefore prevents a rotation of the pivoting lever 30 in direction A. If the latching web is then moved into a released position by means of pressure on the flexible wall 36, the latching web can rotate past the blocking contour when the pivoting lever 30 is pivoted in direction A.

The locking device 40 can therefore be unlocked by means of a manual unlocking movement. Here, in addition, a movement direction for actuating the switch 10 and a direction of the unlocking movement are substantially identical. Moreover, the switch 10 is necessarily actuated before or at the same time as the unlocking action when the unlocking movement is carried out.

FIG. 10 shows an outline illustration of the positioning of a push-push element, based here on the FIG. 1 and FIGS. 3-5, which, however, is preferably arranged in the same way as in the embodiments of FIGS. 6*a*-9*b*. Here, the coupling region 33 has a freewheel in the form of a slotted guide for the Bowden cable nipple.

In all embodiments which are shown, the longitudinal extent 30*a* of the pivoting lever 30 is preferably greater than the transverse extent or the cross section of the interior door pull handle 130, and the rotational axis 21.1 is preferably oriented substantially parallel to the roadway plane or the vehicle floor and transversely with respect to the straight-ahead driving direction of the motor vehicle. In addition, it is preferred in all embodiments if a spring prestresses the pivoting lever 30 in direction B, counter to direction A, this preferably being a separate spring to a possible spring, for example, of the door catch, counter to which spring the mechanical actuating means 140 already operates.

FIGS. 11*a*-11*c* show an outline illustration of a door lock actuator 1, based on FIG. 1, having an additional pressure mechanism 50 in different states. The embodiment as an interior door actuator, an interior door pull handle 130 and the integration of the pivoting lever 30 into the handle region 131 of the interior door pull handle 130 are not absolutely necessary, which can be claimed, for example, as a separate application.

The pivoting lever 30 has a stowed position (FIG. 11*a*) and a protruding position (FIG. 11*b*). In the stowed position, the pivoting lever 30 merges all the way around in a flat and flush manner into the surfaces which adjoin it. In the protruding position, the pivoting lever 30 can be gripped by a hand, with the result that it can be pulled.

The door lock actuator 1 has an unlockable locking device 40, by means of which a locking action of the pivoting lever 30 with respect to a movement in direction A of the actuation of the mechanical actuating means is provided in the stowed position. The locking action takes place by means of a retaining force maximum which has to be overcome, in order to move the pivoting lever 30 in direction A of the actuation of the mechanical actuating means, starting from the stowed position, the force which is necessary for the further movement of the pivoting lever in the direction of the actuation of the mechanical actuating means first of all being smaller again, after the holding force maximum is overcome, than the retaining force maximum. The stowed position and the protruding position are defined by means of the locking device 40 in such a way that, insofar as they have been assumed, they are stable positions, in which the pivoting lever 30 remains, if no additional active force (for example, manual pushing/pulling, electrically produced force) is applied to it. The locking device 40 has two springs 43, 44 which are stressed antagonistically with respect to one another and the one rest position of which defines the protruding position of the pivoting lever 30. The spring 44 The spring 43 is a catch spring 43 and the other spring 44 is a linear spring. Together with the other spring 44, the catch spring 43 defines a second rest position which defines the stowed position of the pivoting lever 30. Here, the linear spring 44 is a spiral spring which is plugged onto a fixed pin and the one end of which presses against a pin of the pivoting lever 30. In FIG. 11*a*, the catch spring 43 is pressed in to the greatest extent and is situated on the other side (in relation to the relieved state, FIG. 11*c*) of the snap-over point in the second region, the catch spring 43 is on this side of the snap-over point in the first region in FIG. 11*a*, and the catch spring 43 is completely relieved in FIG. 11*c*. The catch spring 43 loads the pivoting lever 30 in direction A, that is to say it presses it from the stowed position into the protruding position; the other spring 44 loads the pivoting lever 30 in direction B.

The door lock actuator 1 has a manually actuable electric switch 10 which is connected via a signal line to the door lock, with the result that the door lock can be actuated electrically by way of the switch 10.

In addition to the pivoting lever 30, the door lock actuator 1 has a pressure mechanism 50, the pressure mechanism 50 being set up to deflect a manual pressure force which acts on it (arrow in FIG. 11*b*) onto the pivoting lever 30 in direction A of the actuation of the mechanical actuating means.

The pressure mechanism 50 has a touch surface 51 which can be manually pressed directly as part of the rocker 52 which is mentioned in the following text. The touch surface 51 is arranged directly adjacently with respect to the pivoting lever 30. The pressure mechanism 50 is a purely mechanical gear mechanism which couples the touch surface 51 to the pivoting lever 30. The pivoting lever 30 can be pressed out actively by means of the pressure mechanism 50, with the result that it can be gripped. The pressure mechanism 50 is mounted on its own in relation to the vehicle door, via the rocker axis 52.1 here (see below).

The pressure mechanism 50 has a rocker 52. The rocker 52 is mounted such that it can be rotated about a rocker axis 52.1. The rocker axis 52.1 is parallel to the pivoting axis 21.1 of the pivoting lever 30. The rocker 52 has a pivoting lever coupling section 52.2. The latter is arranged rotated by approximately 180° about the rocker axis 52.1 with regard to the touch surface 51. The rocker axis 52.1 lies between the touch surface 51 and the pivoting lever coupling section 52.2. In FIGS. 11*b* and 11*c*, the pivoting lever coupling section 52.2 bears against the pivoting lever 30 and is set up to transmit a rotation of the rocker 52 about the rocker axis 52.1 to the pivoting lever 30, with the result that the pivoting lever 30 pivots in direction A.

The rocker 52 is set up to directly actuate the manually actuable electric switch as a consequence of a pressure on the sensor surface 51 and the resulting movement of the touch surface 51. In that pivoting range of the rocker 52 which is required for actuating the switch 10, the rocker 52 preferably does not yet bear against the pivoting lever 30, with the result that no deflection of the pressure force onto the pivoting lever 30 yet takes place during a switch actuation and said pivoting lever 30 remains at rest. The rocker 52 is set up to move the pivoting lever 30 in direction A during a movement of the touch surface 51 which goes beyond the movement for actuating the electric switch 10. The switch can thus be actuated by way of light/normal pressing, and the pivoting lever 30 is moved, for example, into the protruding position by way of pronounced pressing.

The rocker 52 is prestressed by means of a spring into a rest position (FIG. 11*a*). Here, it is the other spring end of the spring 44, which also prestresses the pivoting lever 30 in direction B into the stowed position, which loads the rocker 52, with the result that only one spring 44 is necessary, in order to hold the pivoting lever 30 and rocker 52 in their rest position. The rest position of the rocker 52 is such that the touch surface 51 merges in a flat and flush manner into the surfaces which adjoin it.

The locking device 40 can be unlocked by means of a manual unlocking movement (pressure on the pressure surface 51), and a movement direction for actuating the switch 10 and a direction of the unlocking movement are therefore identical, since, in the case of a further pressure beyond the actuating point of the switch 10, the pivoting lever 30 can be moved out of its stowed position which is locked by means of the two springs 43, 44 into the protruding position which is then no longer locked.

It is also conceivable, however, that the pivoting lever 30 is prestressed permanently in the direction of the protruding position by way of (preferably only) one spring and then forms a rest position there by way of another spring (which can also be a spring of the mechanical door actuation). A blocking element, however, locks the pivoting lever 30 in the stowed position first of all. By way of pivoting of the rocker 52 beyond the actuating point of the switch 10, the blocking element is then released and the pivoting lever 30 jumps out.

A possible operation of the example which is shown in FIGS. 11*a*-11*c* is as follows: in order to actuate the door lock electrically, the user can actuate the switch 10 via the rocker 52 by way of light pressure on the pressure surface 51. The pivoting lever 30 does not move here. If the user releases the pressure surface 51 again, the rocker 52 is restored back into its flush starting position on account of the spring 44. Then, for example in the case of an emergency, the pivoting lever 30 can be moved out of the stowed position into the protruding position (FIG. 11*b*) by means of the rocker 52, by means of a more pronounced pressure on the pressure surface 51. During the transition from the stowed position into the protruding position, the catch spring 43 snaps back from the snapped-over state into the non-snapped-over state, said catch spring 43 exerting a greater force on the pivoting lever 30 than previously in the non-snapped-over state close to the snap-over point (FIG. 11*b*). The force which is applied to the pivoting lever 30 in the opposite direction in this position by way of the spring 44 is not sufficient, in order to move the catch spring 43 into the snapped-over state again (FIG. 11*a*). As a consequence, when the user releases the pressure surface 51, although the rocker 52 moves back into its rest position again (FIG. 11*a*) on account of the spring 44, the pivoting lever 30 remains in the protruding position, since a spring equilibrium of the non-snapped-over catch spring 43 and the spring 44 is present in said position. From here, the user can grip the pivoting lever 30 and mechanically actuate the door lock in a pulling manner (FIG. 11*c*).

This invention has presented a door handle for the interior actuation of the vehicle side door including the door lock, in the case of which door handle there is firstly a large lever for mechanical door lock actuation, and secondly there is very satisfactory integration and therefore an installation-saving manner with few components.

The invention claimed is:

1. A side door of a motor vehicle, comprising:

a door lock having a mechanical actuating means;

a door lock actuator connected to the door lock, the door lock actuator being an interior door actuator and having a pivoting lever pivotably mounted about a rotational axis of a joint, the pivoting lever having a coupling section connected to the mechanical actuating means;

an electric switch disposed in the pivoting lever and connected to the door lock via a signal line; and an interior door handle having one or more fastening regions, and at least one handle region, the handle region defining an opening to receive a hand and having an axial extent, wherein:

the pivoting lever is integrated into the handle region of the interior door handle, and the rotational axis is oriented substantially transversely with respect to the axial extent.

2. The side door of claim 1, wherein:

the pivoting lever extends into at least one of the fastening regions, and the handle region has curved surfaces.

3. The side door of claim 1, wherein:

the pivoting lever has an upper side, and the upper side is configured to mate with one or more of the fastening regions.

4. The side door of claim 1, wherein:

the door lock actuator has an inertia compensation spring, the inertia compensation spring urges the pivoting lever in a first pivoting direction, the first pivoting direction is counter to a second pivoting direction for actuating the mechanical actuating means, and the inertia compensation spring urges the pivoting lever in the first pivoting direction only when the pivoting lever has been moved from a stowed position into a protruding position.

5. The side door of claim 1, wherein:

the door lock actuator has a push-push element, and when the pivoting lever is pushed, the push-push element pivots the pivoting lever into a protruding position from a stowed position.

6. The side door of claim 1, wherein:

the door lock actuator has a locking device, the locking device is unlockable, and the locking device selectively retains the pivoting lever in a stowed position.

7. The side door of claim 6, wherein the locking device has a first spring and a second spring to control movement of the pivoting lever from the stowed position to a protruding position.

8. The side door of claim 7, wherein the first spring is a catch spring to urge the pivoting lever toward the stowed position.

9. The side door of claim 6, wherein:

the locking device has a rocker, the rocker is movable between a latched position and an unlatched position, when the rocker is in the latched position, the rocker retains the pivoting lever in the stowed position, when the rocker moves from the latched position to the unlatched position, the rocker pushes the pivoting lever to a protruding position, and the rocker exits the latched position via one or more of a predefined pivoting movement and manual tensioning of a spring element.

10. The side door of claim 1, wherein:

the door lock actuator has a locking device, the locking device has a push-push element, the push-push element selectively retains the pivoting lever in a stowed position, when the push-push element is released via a movement of the pivoting lever in a first direction, the push-push element pushes the pivoting lever in a second direction from the stowed position into a protruding position, and the second direction is opposite the first direction.

11. The side door of claim 1, wherein the electric switch selectively electrically actuates the door lock.

12. The side door of claim 11, wherein the electric switch and the mechanical actuating means are actuated in a first movement direction.

13. The side door of claim 11, wherein:

the door lock actuator has a locking device, when the pivoting lever moves in a first direction, the pivoting lever unlocks the locking device, and when the electric switch moves in the first direction, the electric switch actuates the door lock.

14. The side door of claim 1, wherein:

the door lock actuator has a pressure mechanism, and the pressure mechanism is configured to push the pivoting lever from a stowed position to a protruding position.

15. A module for a side door of a motor vehicle comprising:

a door lock actuator connected to a door lock, the door lock actuator being an interior door actuator and having a pivoting lever pivotably mounted about a rotational axis of a joint, the pivoting lever having a coupling section connected to a mechanical actuating means of the door lock;

an electric switch disposed in the pivoting lever and connected to the door lock via a signal line; and an interior door handle having one or more fastening regions, and at least one handle region, the handle region defining an opening to receive a hand and having an axial extent, wherein:

the pivoting lever is integrated into the handle region of the interior door handle, and the rotational axis is oriented substantially transversely with respect to the axial extent.

* * * * *